US006026621A

United States Patent [19]

Fisher

[11] Patent Number: 6,026,621

[45] Date of Patent: Feb. 22, 2000

[54] MUNTIN

[76] Inventor: Myles A. Fisher, 2006 E. Mallory St., Pensacola, Fla. 32503

[21] Appl. No.: 09/038,126

[22] Filed: Mar. 11, 1998

[51] Int. Cl.[7] ..... E04C 2/00

[52] U.S. Cl. ..... 52/308; 52/62; 52/395; 52/456; 52/468; 52/716.1

[58] Field of Search ..... 52/308, 456, 573.1, 52/468, 62, 393, 395, 716.1

[56] References Cited

U.S. PATENT DOCUMENTS

| | | | |
|---|---|---|---|
| 325,032 | 8/1885 | Wetmore | 52/468 |
| 2,245,633 | 6/1941 | Wolfe | 52/468 |
| 3,066,451 | 12/1962 | Petty | 52/468 |
| 3,252,260 | 5/1966 | Mills | 52/308 X |
| 3,339,329 | 9/1967 | Berg | 52/468 X |
| 3,678,651 | 7/1972 | Hicks | 52/456 X |
| 3,760,544 | 9/1973 | Hawes et al. | 52/468 |
| 4,067,155 | 1/1978 | Ruff et al. | 52/395 X |
| 4,533,278 | 8/1985 | Corsover et al. | 52/393 X |

*Primary Examiner*—Beth Aubrey
*Assistant Examiner*—Brian E. Glessner
*Attorney, Agent, or Firm*—Peter Loffler

[57] ABSTRACT

A muntin for attachment to a construction block structure is constructed of a tubular member having a top and a bottom. A channel extends along the length of the bottom. At least one prong, having a generally triangular head extends outwardly from the channel. The muntin is placed into a grout groove of the construction block structure such that the prong and head are received within the grout and the grout seeps into the channel. Once the grout dries, the muntin is securely held to the construction block structure.

2 Claims, 4 Drawing Sheets

MUNTIN

BACKGROUND OF THE INVENTION

1. Field of the Invention

The present invention relates to a muntin system usable with a construction block structure.

2. Background of the Prior Art

Muntins have been used with windows and other partition structures for many years. However, they have not been used most construction block structures due to the awkwardness of installation of the muntin to the structure.

Therefore, there is a need in the art for a muntin that can be attached to a construction block structure in order to change or enhance the appearance of the structure. The muntin should not be awkward or otherwise difficult to install and should be readily replaceable.

SUMMARY OF THE INVENTION

The muntin of the present invention addresses the aforementioned needs in the art. The muntin is quickly and easily attached to a construction block structure along the grout groove formed between adjacent construction blocks. The muntin is of relatively simple and straightforward design.

A muntin is comprised of a tubular member having a top and a bottom. The top and the bottom combine to give the muntin any desired shape such as rectangular, hemishirical, triangular, etc. The exact shape is dependant on the type of look desired as well as the shape of the grout groove to which the muntin is to be positioned. A channel extends along the length of the bottom. At least one prong, having a generally triangular head extends outwardly from the channel. The muntin is placed into a grout groove of the construction block structure such that the prong and head are received within the grout and the grout seeps into the channel. Once the grout dries, the muntin is securely held to the construction block structure. The head of the prong prevents the muntin from being withdrawn from the grout.

Alternately, the muntin comprises a top and a bottom defining a channel. The top and the bottom combine to give the muntin any desired shape such as rectangular, hemishirical, triangular, etc. A continuous opening or a plurality of spaced apart openings is located on the bottom. The muntin is placed into a grout groove of the construction block structure such that the grout seeps into the channel through the continuous opening or plurality of openings. Once the grout dries, the muntin is securely held to the construction block structure. The bottom prevents the muntin from being withdrawn from the grout.

BRIEF DESCRIPTION OF THE DRAWINGS

Similar reference numerals refer to similar parts throughout the several views of the drawings.

DESCRIPTION OF THE PREFERRED EMBODIMENT

Figure 1:
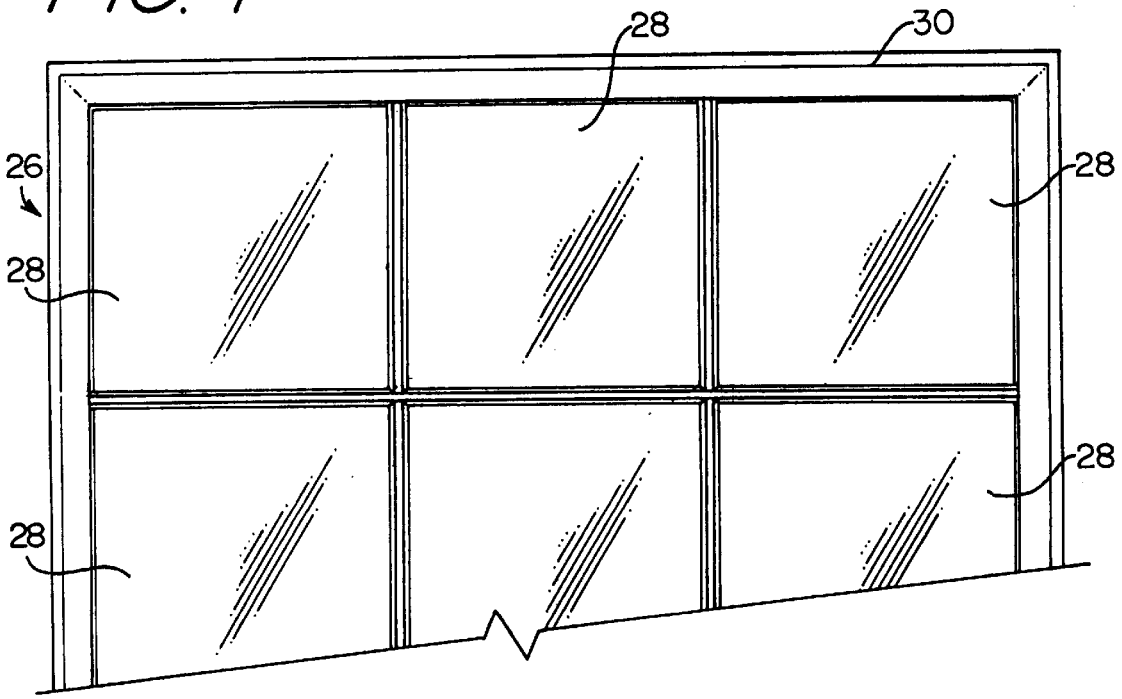
FIG. 1 is a partial close-up view of a construction block structure with the muntin of the present invention.

Referring now to the drawings, it is seen that the muntin of the present invention, generally denoted by reference numeral 10, is comprised of a base member 12, which may be tubular, 12 having a top 14 and a bottom 16. A channel 20 extends along the length of the bottom 16. At least one prong 22 extends outwardly from the channel 20 and has a head 24 disposed on the top of the prong 22. As seen, the head 24 has a pointed end and may be triangular in shape. Although the prong 22 and head 24 are illustrated as one continuous member, a plurality of spaced apart prongs 22 with attached heads 24 can also be utilized.

Figure 2:
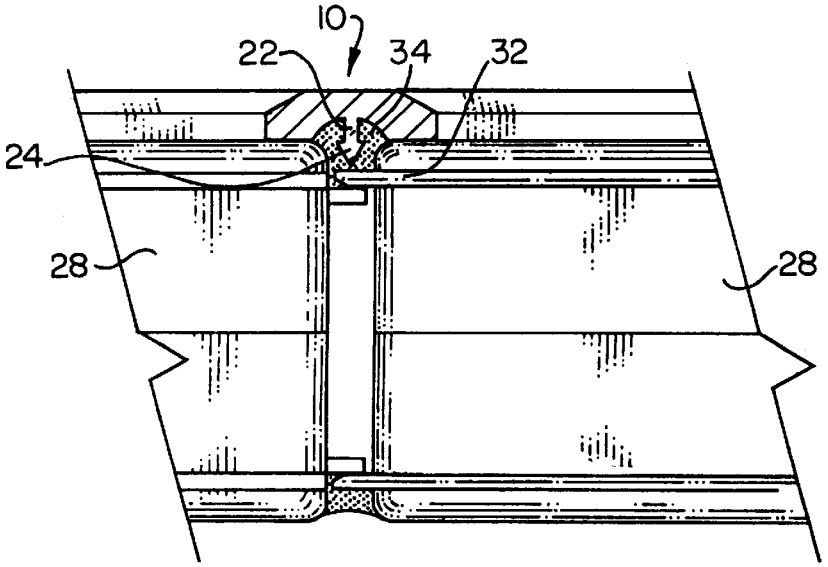
FIG. 2 is a cross-section view of the construction block structure with the muntin.
Figure 3:
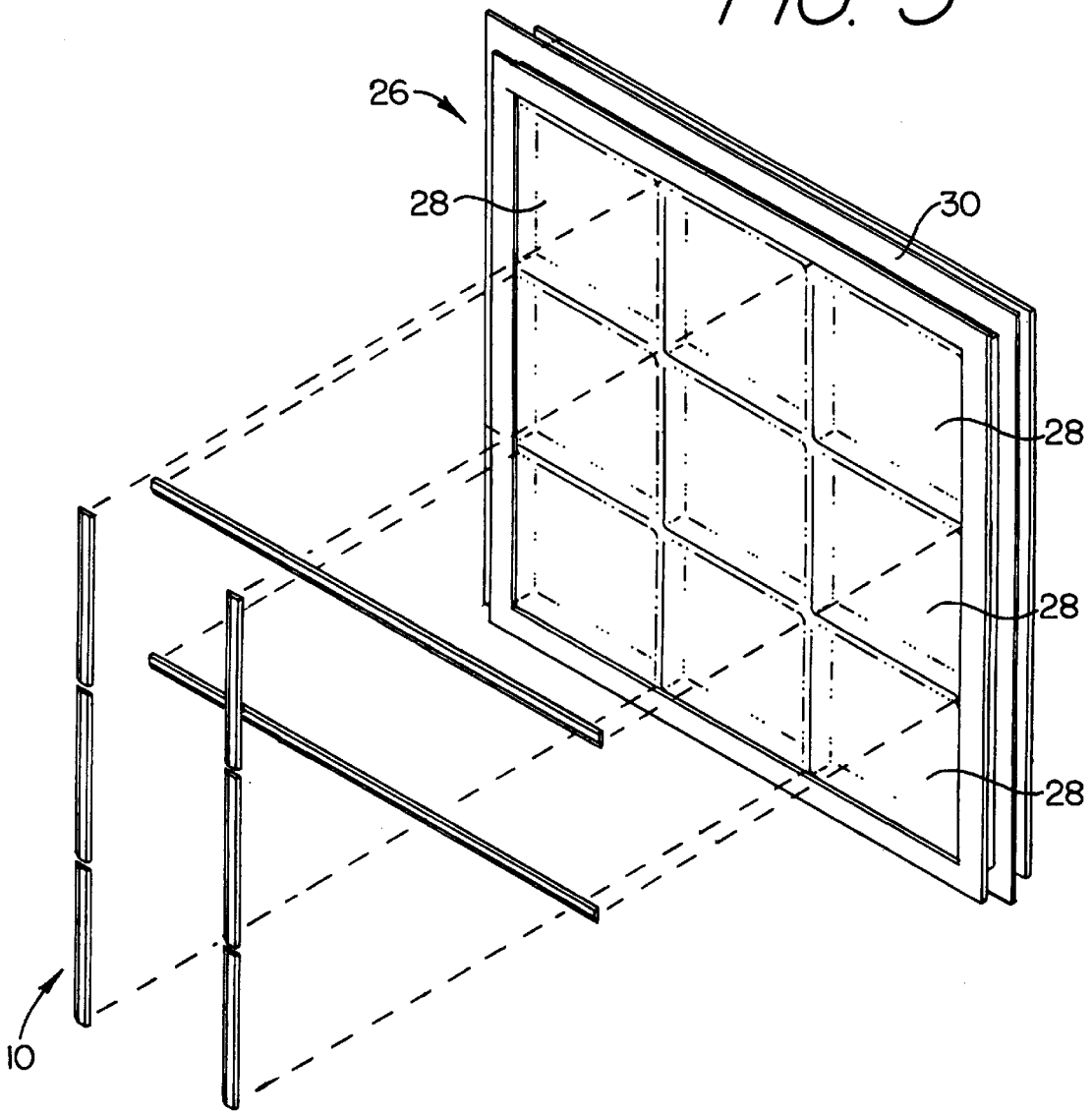
FIG. 3 is a perspective view of the muntin exploded from the construction block structure.

As seen in FIGS. 1–3, a construction block structure 26 is comprised of a plurality of interconnected construction blocks 28, the construction blocks 28 being interconnected in any desired fashion known in the art. The construction block structure 26 may, but need not be disposed within a frame 30. A grout groove exists between each pair of adjacent construction blocks 28. The construction blocks 28 may have one or more flanges 32 that help define the grout groove. Grout 34, of any appropriate composition, such as silicone and the like, is disposed within the grout groove.

In order to utilize the muntin 10, the grout 34 is placed into the grout groove and while the grout is still wet, the muntin 10 is placed onto the construction block structure 26 such that the prong 22 and head 24 are received within the grout 34 and the grout 34 seeps into the channel 20. As seen in FIG. 2, once the grout 34 dries, the muntin 10 is securely held to the construction block structure 26. The base of the head 24 prevents the muntin 10 from being pulled out of the grout 34. If multiple muntins 10 are used on a single construction block structure 26, then at least one of the intersecting muntins 10 is appropriately formed so as to assure an aesthetically appealing "crossing" of muntins 10.

Figure 6:
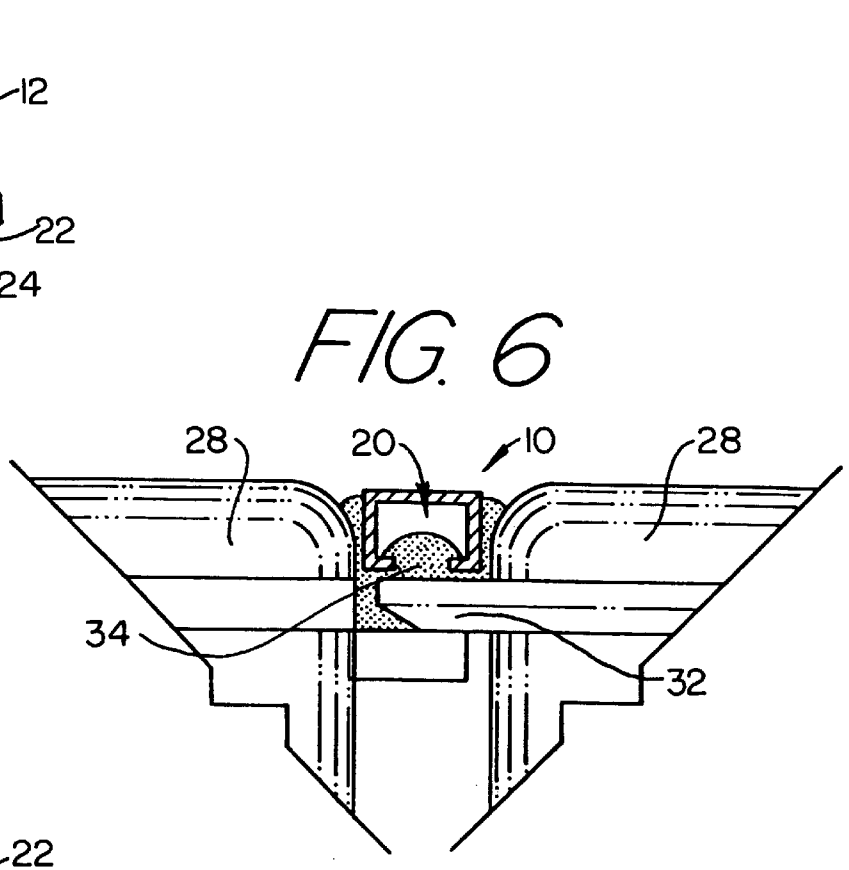
FIG. 6 is a cross-section view of the construction block structure with an alternate embodiment of the muntin.
Figure 4:
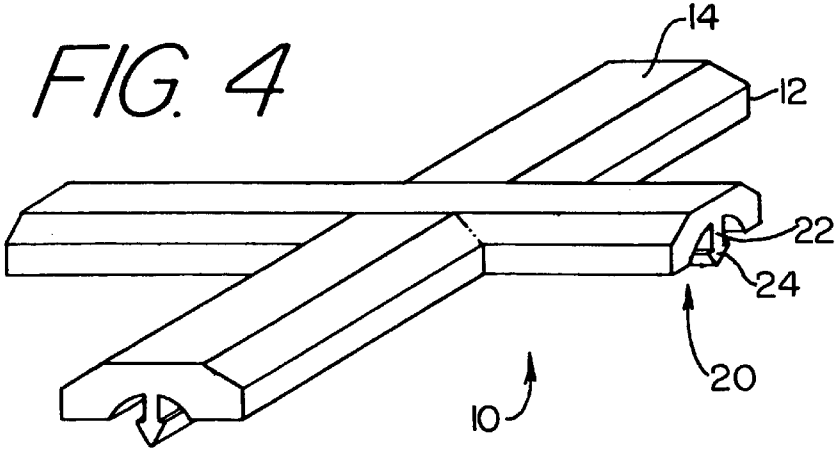
FIG. 4 is an upper perspective view of the muntin.
Figure 5:
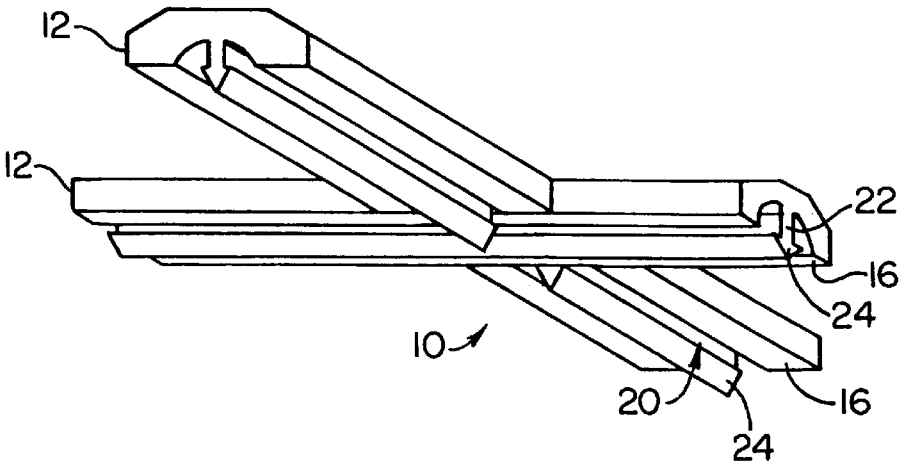
FIG. 5 is a lower perspective view of the muntin.
Figure 7:
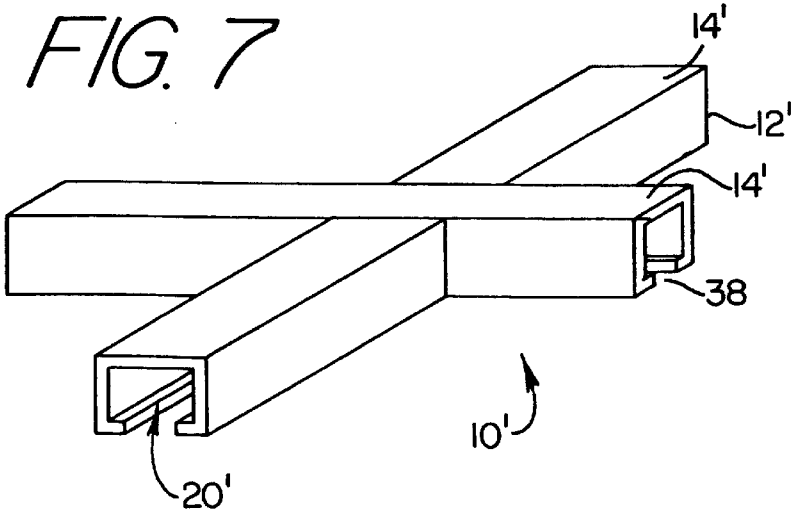
FIG. 7 is an upper perspective view of an alternate embodiment of the muntin having a continuous opening.
Figure 8:
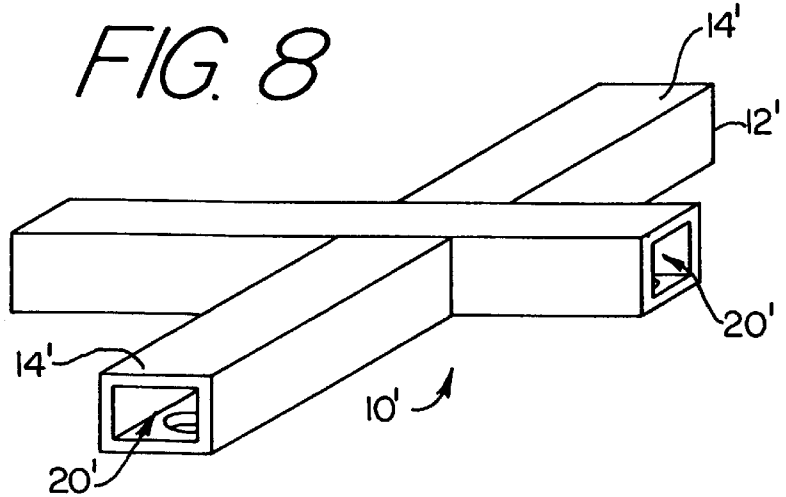
FIG. 8 is an upper perspective view of an alternate embodiment of the muntin having a plurality of openings.
Figure 9:
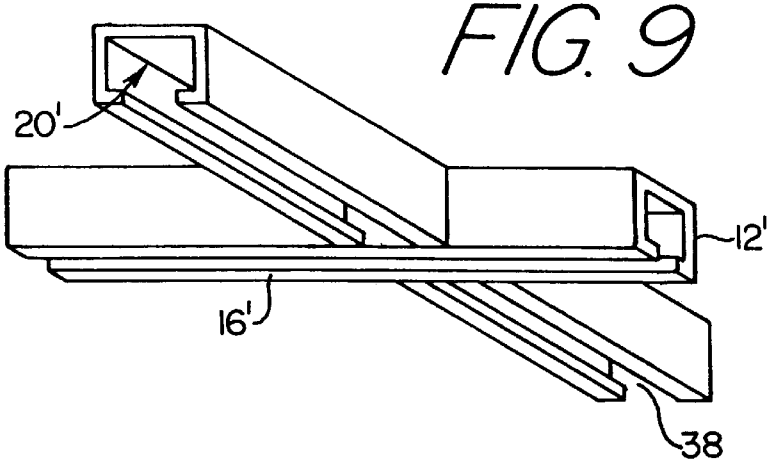
FIG. 9 is a lower perspective view of an alternate embodiment of the muntin having a continuous opening.
Figure 10:
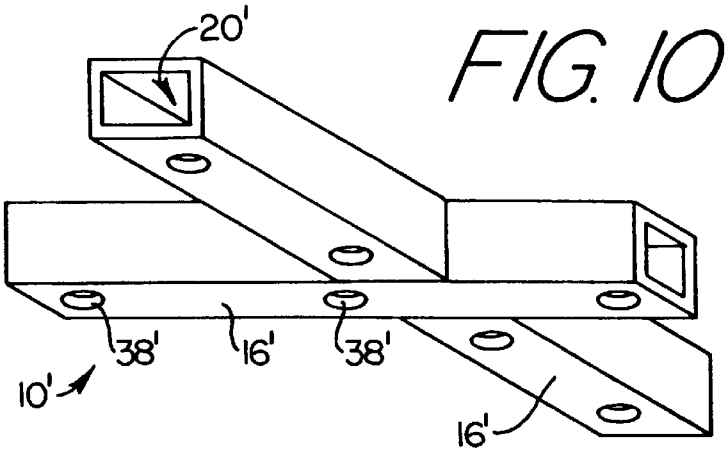
FIG. 10 is a lower perspective view of an alternate embodiment of the muntin having a plurality of openings.

As seen in FIGS. 7–10, an alternate embodiment of the muntin 10' of the present invention comprises a tubular member 12' having a top 14' and a bottom 16' that define a channel 20'. A single opening 38 or a plurality of openings 38' are located on the bottom 16'. When the muntin 10' is placed onto the construction block structure 26, the grout seeps into the channel 20' through the continuous opening 38 or the plurality of openings 38'. As seen in FIG. 6, once the grout 34 dries, the muntin 10 is securely held to the construction block structure 26. The bottom 16' prevents the muntin 10 from being pulled out of the grout 34.

While the invention has been particularly shown and described with reference to an embodiment thereof, it will be appreciated by those skilled in the art that various changes in form and detail may be made without departing from the spirit and scope of the invention.

I claim:

1. A muntin, in combination with a construction block structure, the construction block structure comprising a plurality of interconnected construction blocks with a grout groove formed at an intersection of each interconnected construction block pair and grout disposed within the grout groove, the muntin comprising:

a tubular member having a top and a bottom;

a channel extending along the length of the tubular member; and an opening located on the bottom such that tubular member is placed into the grout groove and the grout passes through the opening into the channel.

2. A muntin, in combination with a construction block structure, the construction block structure comprising a plurality of interconnected construction blocks with a grout groove formed at an intersection of each interconnected construction block pair and grout disposed within the grout groove, the muntin comprising:

a tubular member having a top and a bottom;

a channel extending along the length of the tubular member; and a plurality of openings located on the bottom such that tubular member is placed into the grout groove and the grout passes through the plurality of openings into the channel.

* * * * *